United States Patent [19]

Mason

[11] 3,975,075

[45] Aug. 17, 1976

[54] UNITARY OFFSET WALL PLUG

[75] Inventor: John Richard Mason, Thousand Oaks, Calif.

[73] Assignee: Dracon Industries, Chatsworth, Calif.

[22] Filed: Sept. 18, 1974

[21] Appl. No.: 506,954

[52] U.S. Cl. ..... 339/102 R; 339/14 P; 339/166 R

[51] Int. Cl.[2] ..... H01R 13/58

[58] Field of Search ..... 339/102 R, 14 P, 14 R, 339/62, 66 R, 66 M, 166 R, 191 R, 195 R, 195 A, 206 P, 262 P, 217 PS, 217 TP

[56] References Cited

UNITED STATES PATENTS

| | | | |
|---|---|---|---|
| 1,981,458 | 11/1934 | McCloy et al. | 339/217 TP X |
| 2,894,242 | 7/1959 | Bickford et al. | 339/102 X |
| 3,045,201 | 7/1962 | Hall | 339/14 R |

*Primary Examiner*—Roy Lake
*Assistant Examiner*—DeWalden W. Jones
*Attorney, Agent, or Firm*—Flehr, Hohbach, Test, Albritton & Herbert

[57] ABSTRACT

A molded one-piece wall plug having a pair of electrical contacts and a ground contact extending from one flat face thereon. The body of the wall plug is approximately a right circular cylinder with the flat face forming one end of the cylinder. A strain-relief sleeve extends in a tangential direction from the periphery of the body and is spaced above the plane containing the flat face of the plug. A multi-conductor cable is led through the strain-relief sleeve into the interior of the plug body having separate conductors connected to each of the electrical contacts and the ground contact. The tangential direction of departure of the strain-relief sleeve from the periphery of the wall plug body is such as to lead the multi-conductor cable in a direction so that when the electrical contacts are inserted in an electrical wall receptacle the cable will not overly any other receptacle in a standard array of receptacles having two rows and at least one column of receptacles.

3 Claims, 3 Drawing Figures

UNITARY OFFSET WALL PLUG

BACKGROUND OF THE INVENTION

The invention disclosed herein is directed to an offset wall plug and more particularly to such a wall plug for use with a multi-receptacle electrical outlet box allowing cable take-off parallel with the face of the box without interfering with other such plugs inserted in adjacent receptacles in the outlet box.

It is generally a desirable feature in power cables for making power connections at an electrical outlet box for the conductor cable to run off from the electrical outlet in a direction parallel to the face of the outlet box. Thus power cables are kept close to the face of the outlet box and are not as likely to be struck and damaged by passing equipment and personnel. Standard arrays of receptacles in an outlet box having two rows, one above the other, and one or more columns of receptacles, have the receptacles spaced relatively close together, so that when a plug is placed in one receptacle the cable take-off direction may overlie an adjacent receptacle blocking entry thereto by another plug. The problem is aggravated when a ground contact is present in the plug, since the plug may now be inserted into a receptacle in one orientation only.

There is therefore a need for a compact unitary wall plug providing for a cable take-off direction which will direct the conductor cable parallel to the face of the electrical outlet box in a direction so that it will not overlie any adjacent receptacles when the plug to which it is attached is inserted in one of the receptacles.

SUMMARY AND OBJECTS OF THE INVENTION

The invention disclosed herein includes a unitary body on a wall plug having a generally right circular cylindrical shape and one flat face at one end of the cylinder. A pair of electrical contacts extend from the flat face in a pattern adapted to fit into a standard electrical wall receptacle. A ground contact may also extend from the flat face at a position relative to the electrical contacts adapted to fit into a standard wall receptacle containing a ground socket. A strain-relief sleeve extends tangentially from the periphery of the plug body in a direction forming an acute angle with a line equidistant from the electrical contacts and parallel to the flat face. A multi-conductor electrical cable extends through the strain-relief sleeve to the interior of the wall plug body where separate conductors are connected to each electrical contact and the ground contact. The multi-conductor electrical cable is directed by the strain-relief sleeve in a direction parallel to the face of the electrical outlet box such that when the plug is inserted into one of the receptacles the cable does not overlie any other receptacle position in a standard electrical box array of receptacles carrying two rows and at least one column of receptacles.

It is an object of the present invention to provide a wall plug which may be inserted in any receptacle in a multi-receptacle electrical outlet box which will not interfere with the insertion of a like wall plug in an adjacent receptacle.

It is another object of the present invention to provide a wall plug of unitary construction for directing the connecting conductor cable in a direction parallel to the surface supporting the receptacle.

These and other objects of the invention will become apparent upon consideration of the following detailed description together with the attached drawings.

DESCRIPTION OF THE PREFERRED EMBODIMENTS

Figure 1:
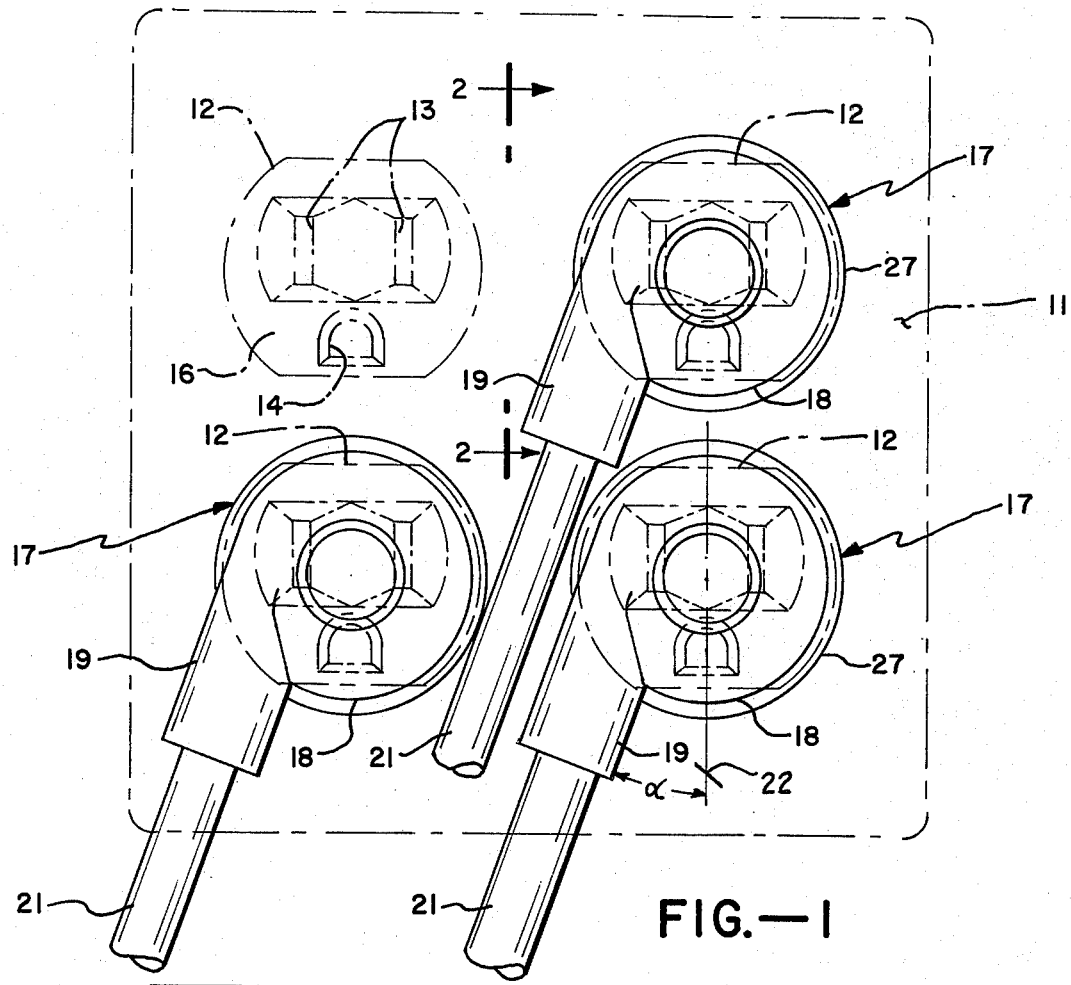
FIG. 1 is a plan view of a standard quad array of electrical outlets with unitary wall plugs inserted therein.

FIG. 1 shows the face plate 11 of a multi-receptacle electrical outlet box having an array of four receptacles 12 therein arranged in two horizontal rows and two vertical columns. Receptacles 12 have a standard pattern of apertures 13 for receiving male contacts on an electrical wall plug and an aperture 14 for receiving a ground contact on such a plug. An insulated receptacle face 16 is positioned substantially flush with face plate 11.

A wall plug 17 is shown inserted in each of three of the four receptacles shown. Wall plugs 17 have a one-piece molded body 18 with an integral strain-relief sleeve 19 extending tangentially from the periphery of body 18 thereby providing a unitary construction. A multi-conductor cable 21 extends through strain-relief sleeve 19 into the interior of plug body 18. Strain-relief sleeve 19 departs from plug body 18 in a direction which forms an acute angle with a line 22 shown in FIG. 1.

Figure 2:
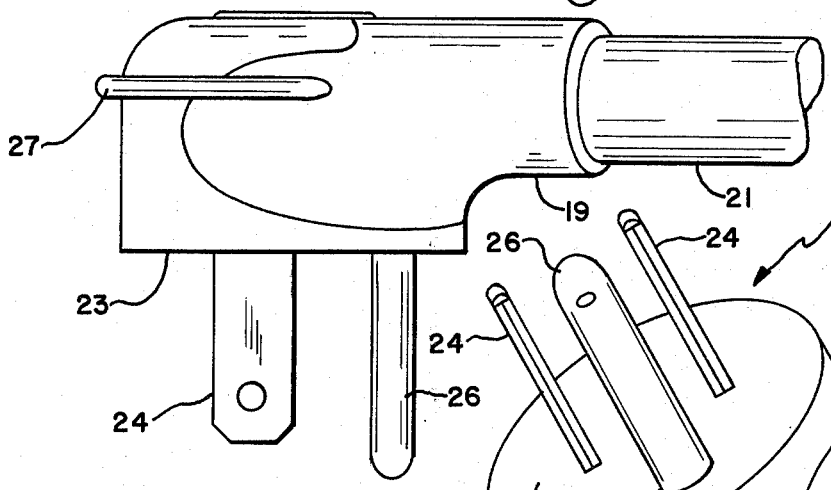
FIG. 2 is an elevational view of the unitary wall plug along the line 2—2 of FIG. 1.
Figure 3:
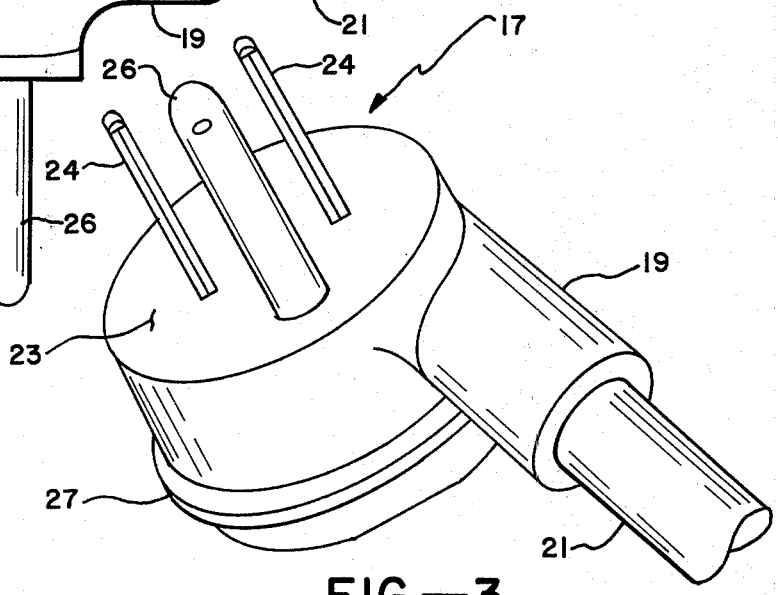
FIG. 3 is an isometic view of the unitary wall plug from the electrical contact side.

Referring to FIG. 2 in conjunction with FIG. 1, plug body 18 is seen to have a generally circular cylindrical shape with a flat face 23 at one end substantially perpendicular to the cylindrical axis of body 18. As may be seen by reference to FIGS. 2 and 3 together a pair of electrical contacts 24 extend substantially orthogonally from flat face 23 in a pattern adapted to match the pattern of apertures 13 in receptacles 12. A ground contact 26 also extends substantially orthogonally from flat face 23 positioned on a line equidistant from electrical contacts 24 and in a position adapted to fit into aperture 14 in receptacle 12.

It may now be seen that line 22 in FIG. 1 is a line equidistant from electrical contacts 24 and that the direction of departure of strain-relief sleeve 19 from the periphery of plug body 18 forms an acute angle with a line equidistant from electrical contacts 24 and represented by line 22 in FIG. 1. The angle illustrated is substantially 25°. Line 22 is in a plane parallel to flat face 23 which contains the center line of strain-relief sleeve 19. As may also be seen in FIGS. 2 and 3 strain-relief sleeve 19 is spaced from the plane in which flat face 23 lies. Multi-conductor cable 21 is therefore directed parallel to the plane of face plate 11 spaced therefrom by sleeve 19 to provide clearance between any slight protruding members such as holding screws (not shown), etc. on the surface of face plate 11. Plug body 18 also has formed thereon a gripping ring 27 by which the unitary assembly may be manually held for insertion of electrical contacts 24 into apertures 13 as well as extraction therefrom.

Referring back to FIG. 1 it may be seen that when a ground contact 26 is included in the wall plug 17 the orientation of wall plug 17 in receptacles 12 is fixed.

Therefore when a plurality of wall plugs 17 are placed in a standard array of receptacles 12 such as seen in FIG. 1, strain-relief sleeve 19 leads the multi-conductor cables 21 in a direction both parallel to face plate 11 and such that cables 21 avoid overlaying any other receptacles 12 in the same or adjacent rows or columns of receptacles 12.

There has been disclosed a wall plug of unitary construction which leads the connecting cable off in a direction parallel to the receptacle face plate and which also allows a plurality of such wall plugs to be inserted in a standard array of receptacles without interference between the plugs and the cables.

I claim:

1. A wall plug for insertion in a multi-receptacle outlet box having a rectangular receptacle pattern, comprising a unitary body member of generally cylindrical shape, a flat face on one end of said body oriented substantially perpendicular to the cylindrical axis thereof, a pair of electrical contacts extending from said flat face, adapted for insertion in a standard electrical wall receptacle, a ground contact extending from said flat face at a point equidistant from said electrical contacts, a strain-relief sleeve extending tangentially from the periphery of said body in a direction forming an actue angle with a line parallel to the plane of said flat face and equidistant from said electrical contacts, said strain relief sleeve being spaced from the plane of said flat face thereby clearing protrusions above the face of the rectangular array, and a multi-conductor cable passing through said strain-relief sleeve to the interior of said body and having separate conductors connected to each of said pair of electrical contacts and said ground contact, so that when said contacts are inserted into one of the receptacles said multi-conductor cable extends parallel to the face of the multi-receptacle outlet box in a manner to avoid overlying any of the other receptacles in the rectangular receptacle array.

2. A wall plug as in claim 1 together with means on the periphery of said body for providing a manual grip for facilitating insertion and extraction of said electrical contacts in the electrical receptacles.

3. A wall plug as in claim 1 wherein said acute angle is approximately 25°.

* * * * *